US012102226B2

(12) United States Patent
Block

(10) Patent No.: US 12,102,226 B2
(45) Date of Patent: Oct. 1, 2024

(54) CLOTHES-RAIL SYSTEM HAVING AN INTEGRATED PIPE

(71) Applicant: Patrick Block, Mochenwangen (DE)

(72) Inventor: Patrick Block, Mochenwangen (DE)

( * ) Notice: Subject to any disclaimer, the term of this patent is extended or adjusted under 35 U.S.C. 154(b) by 0 days.

(21) Appl. No.: 18/185,151

(22) Filed: Mar. 16, 2023

(65) Prior Publication Data

US 2023/0329433 A1 Oct. 19, 2023

(30) Foreign Application Priority Data

Apr. 14, 2022 (DE) ..... 20 2022 102 047.7

(51) Int. Cl.
*A47B 61/02* (2006.01)
*A47G 25/06* (2006.01)

(52) U.S. Cl.
CPC ..... *A47B 61/02* (2013.01); *A47G 25/0664* (2013.01)

(58) Field of Classification Search
CPC ... A47B 61/003; A47B 61/02; A47B 96/1425; A47B 96/145; A47B 96/1458; A47F 7/24; A47G 25/0664; A47G 25/0671; A47G 25/0692
USPC ..... 211/172, 187, 191, 196, 204, 205, 206
See application file for complete search history.

(56) References Cited

U.S. PATENT DOCUMENTS 1,015,448 A * 1/1912 Madden ..... F16B 12/40 211/206
2,903,227 A * 9/1959 De Kalb ..... A47B 96/1425 248/200.1
3,035,708 A * 5/1962 Freeman ..... A47B 96/1425 108/147.19
3,291,434 A * 12/1966 Whitechester ..... A47G 25/0664 248/200.1
3,722,702 A * 3/1973 Marker, Jr. ..... A47F 7/24 108/115
4,380,298 A * 4/1983 Harig ..... F16B 2/241 403/245
4,934,015 A * 6/1990 Mink ..... A47L 4/04 15/268
5,086,930 A * 2/1992 Saeks ..... B62H 3/12 248/161
5,303,832 A * 4/1994 Tu ..... A47G 25/0692 211/105.4
5,660,637 A * 8/1997 Dodge ..... B05B 13/0285 211/208

(Continued)

FOREIGN PATENT DOCUMENTS

DE 202022102047 U1 * 6/2022 ..... A47B 61/02

*Primary Examiner* — Jennifer E. Novosad
(74) *Attorney, Agent, or Firm* — Christopher J. Volkmann; Kelly, Holt & Christenson, PLLC.

(57) ABSTRACT

A clothes-rail system for fastening in rooms includes at least one vertically oriented main element with a first end and a second end and at least one transverse element. The at least one transverse element is arranged on the main element in a direction transverse to the at least one main element. The position in which the at least one transverse element is arranged on the at least one main element is variable. The clothes-rail system includes at least a first fastening element and a second fastening element. The first fastening element is arranged at the first end of the at least one main element. The second fastening element is arranged at a second end of the main element.

11 Claims, 6 Drawing Sheets

(56) References Cited

U.S. PATENT DOCUMENTS

| | | | | | |
|---|---|---|---|---|---|
| 5,826,847 | A * | 10/1998 | Warner | F16B 7/1463 | 248/200.1 |
| 6,308,842 | B1 * | 10/2001 | Robbins, III | A47F 7/00 | 211/206 |
| 6,443,319 | B1 * | 9/2002 | Sander | A47B 57/26 | 211/186 |
| 8,167,152 | B1 * | 5/2012 | Gatti | E04B 2/821 | 211/187 |
| 10,543,592 | B2 * | 1/2020 | Esposito | A47B 57/20 | |
| D882,309 | S * | 4/2020 | Yang | D6/681.1 | |
| 10,813,832 | B2 * | 10/2020 | Qiu | A47F 5/103 | |
| 10,988,892 | B1 * | 4/2021 | Lu | A47G 25/0664 | |
| 11,457,735 | B1 * | 10/2022 | D'Isep | A47B 57/045 | |
| 11,882,937 | B2 * | 1/2024 | Hoyt | A47B 96/14 | |
| 2008/0029473 | A1 * | 2/2008 | Hu | A47G 25/0664 | 211/206 |
| 2008/0135509 | A1 * | 6/2008 | Jackson | A47B 96/145 | 211/123 |
| 2012/0097628 | A1 * | 4/2012 | Blacknell | A47G 25/0685 | 211/85.3 |
| 2015/0076092 | A1 * | 3/2015 | Tambornino | A63B 21/078 | 211/85.7 |
| 2017/0055780 | A1 * | 3/2017 | Jepson | A47K 3/281 | |
| 2023/0329433 | A1 * | 10/2023 | Block | A47B 61/02 | |

* cited by examiner

CLOTHES-RAIL SYSTEM HAVING AN INTEGRATED PIPE

CROSS-REFERENCES TO RELATED APPLICATION

This application claims the benefit of German Application No. 20 2022 102 047.7, filed Apr. 14, 2022.

FIELD OF THE DISCLOSURE

The present disclosure relates to a clothes-rail system for fastening in rooms according to the preamble of claim 1.

BACKGROUND

The prior art already discloses a clothes-rail system which is formed from pipes. The known clothes-rail system is set up, in the form of a clothes-rail frame, on the floor of a room and requires feet, which are splayed out in the horizontal plane so that the clothes-rail system does not tip over. However, depending on the size of the clothes-rail system and depending on the loading created by items of clothing hung or placed thereon, these feet have to be splayed out to a fair extent with a large radius. This splaying out can be done either in the vicinity of the floor, in which case they represent a trip hazard, or slightly further away from the floor, in which case other parts of the user's body could bump against the clothes-rail system as he or she is passing, and the feet represent an obstruction for the user.

DETAILED DESCRIPTION

Figure 1:
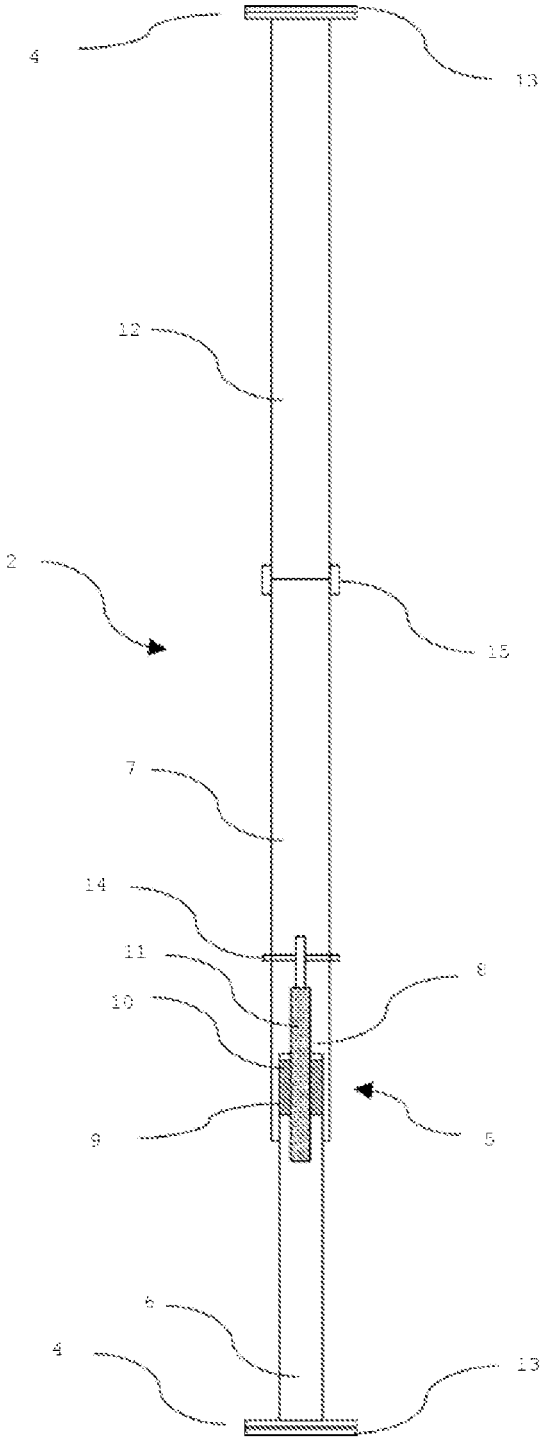
FIG. 1 shows a schematic construction of a main element having an extension mechanism according to one example in an extended state.

In contrast, an object of the present disclosure is to propose a clothes-rail system for fastening in rooms which at least partially remedies the disadvantages of the prior art.

Based on a clothes-rail system of the type mentioned in the introduction, this object is achieved by the features of claim 1. Advantageous embodiments and developments of the present disclosure can be achieved using the measures mentioned in the dependent claims.

Accordingly, a clothes-rail system according to one example of the present disclosure is distinguished in that the at least one main element has an extension mechanism for extending the at least one main element in the vertical direction, wherein the extension mechanism is designed such that the first fastening element and the second fastening element move relative to one another for releasable fastening in a room, wherein the at least one main element and/or the at least one transverse element are/is formed from at least one pipe.

The main element here is extended vertically by the extension element, so that the main element butts against a first spatial boundary of the room and a second spatial boundary of the room and is clamped in therebetween. The clamping force means that the clothes-rail system cannot tilt and can stand in a stable state in the room even when subjected to loading by items of clothing hung thereon and placed thereon, so that it is possible to dispense with splayed-out feet. For example, the first spatial boundary is the floor of the room. Furthermore, the second spatial boundary can be the ceiling of the room. It is also conceivable for beams, door frames or else other pieces of furniture to serve as the spatial boundary of the room. This means that it is possible for the rail system not just to be arranged advantageously at virtually any desired locations in a room where it does not prove to be problematic; it is also possible for the rail system to bear a multiplicity of transverse elements at different heights and therefore to dispense with splayed-out rods or bars for the feet.

The clothes-rail system for fastening in rooms advantageously has at least one essentially vertically oriented main element with a first end and a second end.

For example at least one transverse element is arranged on the at least one main element, wherein the at least one transverse element is arranged on the main element in a direction transverse to the at least one main element. The position at which the at least one transverse element is arranged on the at least one main element can be variable. It is possible here for the at least one transverse element either to be connected in a fixed state to the at least one main element or else to be arranged in a releasable manner thereon. For example, the at least one transverse element can be arranged horizontally. It is preferably the case that, in order to provide for a higher level of stability of the clothes-rail system, a transverse element is arranged on two or more main elements. Arranging a transverse element on more than one main element gives the clothes-rail system more stability.

The transverse element here can be used as a clothes rail on which items of clothing can be hung directly or via clothes hangers or hooks. The transverse element can also be supplemented or even replaced by shelves or boxes, so that items of clothing can be stored thereon or therein, wherein, depending on the use, functionality is increased.

For example, the transverse element can be arranged on the at least one main element via clamps. Also conceivable are embodiments in which sleeves or sub-sleeves are fastened on the transverse elements, the sleeves or sub-sleeves engaging around the main elements and being able to be moved thereon and releasably fixed thereon for example in a stepwise or continuous manner.

It is also conceivable for two or more transverse elements to be arranged on one and/or more main elements, which can likewise increase the stability of the clothes-rail system. Shear forces can be reduced in this way.

For example, the clothes-rail system comprises at least a first fastening element and a second fastening element, wherein the first fastening element is arranged at the first end of the at least one main element, wherein the second fastening element is arranged at a second end of the main element. The clothes-rail system can also comprise a second main element, wherein the second main element has a first end and a second end, wherein a further fastening element is arranged at the first end of the second main element and a further fastening element is arranged at the second end of the second main element. For example, the fastening element can be designed here in the form of a flange or stopper. The main elements can have a greater footing surface area than the single main element, so that the positioning of the clothes-rail system can be more stable even under loading.

The at least one main element has an extension mechanism for extending the at least one main element in the vertical direction, wherein the extension mechanism is designed such that the first fastening element and the second fastening element move relative to one another for releasable fastening in a room. For example, the at least one main element is extended by the extension element to the extent where the fastening elements are arranged at a first spatial boundary of the room and a second spatial boundary of the room. As already described, the first spatial boundary can be the floor of the room. For example, the second spatial boundary is the ceiling of the room. It is also conceivable for beams, door frames or else other pieces of furniture to serve as the spatial boundary of the room. The clothes-rail system be extended such that the at least one main element, the first fastening element and the second fastening element is clamped firmly between the first spatial boundary and second spatial boundary. It is thus possible to utilize for example the entire height of the room when the boundary is created by the ceiling and floor of the room. Even in the case of sloping ceilings or other obstructions in the room, such as beams or furniture, the clothes-rail system can be adapted ideally to the room. Such a system can achieve optimum adaptation to the height of the room.

The at least one main element and/or the at least one transverse element are/is formed from at least one pipe. It is also conceivable for the at least one transverse element and the at least one main element to be formed from pipe. Simple parts which are basically always available are therefore advantageously recycled. In addition, the pipe provides savings in terms of weight and materials used.

In one embodiment, the at least one main element comprises at least a first sub-element and a second sub-element, wherein the first sub-element and/or the second sub-element and/or the at least one transverse element have/has an essentially hollow main body. This makes it possible to provide savings in terms of weight and materials used, as a result of which, on the one hand, it is possible to save on production costs and, on the other hand, assembly is made easier.

For example, the first sub-element and/or the second sub-element and/or the at least one transverse element have/has an essentially cylindrical main body. This also allows rotation of flange systems about the longitudinal axis and greater flexibility.

It is conceivable for the first sub-element to have a longitudinal axis and also for the second sub-element to have a longitudinal axis, wherein the first sub-element and the second sub-element are arranged such that the respective longitudinal axes are oriented in the same direction. It is thus possible for the first sub-element to be arranged on the second sub-element such that the longitudinal axes are located along a common axis. The stability of the clothes-rail system can be improved by such a design.

In the case of a variant, the first fastening element is arranged at one end of the first sub-element and the second fastening element is arranged at one end of the second sub-element.

It is expediently the case that the first sub-element is designed to be movable relative to the second sub-element, wherein the first sub-element and the second sub-element are designed such that at least part of the first sub-element can be moved within the second sub-element.

In the case of a development of the present disclosure, the extension mechanism provides for the releasable fastening of the clothes-rail system in a room by a relative movement of the first fastening element and of the second fastening element in relation to one another being realized by a partial movement of the first sub-element within the second sub-element. Dividing the main element into a number of parts allows the extension to be of simple configuration, without the stability or functionality of the clothes-rail system being reduced.

For example, the extension mechanism has an inner extension element and an outer extension element, wherein the inner extension element has an external thread and the outer extension element has an internal thread, wherein the internal thread and the external thread are designed to complement one another.

In the case of another exemplary embodiment, at least part of the inner extension element is present within the first sub-element or on the outside of the first sub-element and at least part of the outer extension element is present within the second sub-element, wherein the inner extension element is mounted such that it cannot rotate relative to the first sub-element and the outer extension element is mounted such that it cannot rotate relative to the second sub-element.

For example, at least part of the inner extension element can be fixed within the first sub-element or else also on the outside of the first sub-element. In one configuration, the inner extension element can be welded to the first sub-element. In another configuration, it is possible for the external thread to be made in the first sub-element, for example by milling or cutting.

It is preferably the case that at least part of the outer extension element is present within the second sub-element. It is possible for the outer extension element to be welded to the second sub-element. It is also conceivable for the internal thread to be made in the second sub-element, for example by milling or cutting.

For example, at least part of the inner extension element is present within the second sub-element and the outer extension element is present within the first sub-element, wherein the inner extension element is fixed in a releasable manner such that it cannot rotate relative to the second sub-element and the outer extension element is fixed in a releasable manner such that it cannot rotate relative to the first sub-element.

For example, at least part of the inner extension element can be fixed within the second sub-element. The fixing can be achieved by welding.

It is also possible for the inner extension element to be coupled to the second sub-element by means of a fixing element, for example a pin or bolt or a rivet. It is advantageous here if the inner extension element and/or the second sub-element each have at least one hole, through which for example a pin, a bolt or a rivet is fitted.

For example, it is possible for the external thread to be made in the inner extension element, for example by milling or cutting.

It is preferably the case that at least part of the outer extension element is present within the first sub-element. For example, the outer extension element can be welded to the first sub-element. It is possible here for the internal thread to be made in the first sub-element, for example by milling or cutting.

By virtue of the external thread being rotated about the internal thread, it is possible in this way for the first sub-element and the second sub-element to be moved relative to one another, so that the main element extends or, in the case of the opposite direction of rotation, become shorter. It is thus possible, by a straightforward movement, for the main element to be clamped firmly in the room and, if required, also released again.

In one embodiment of the present disclosure, the at least one transverse element is arranged perpendicularly relative to the at least one main element. In the case of essentially vertically arranged main elements, the transverse elements are thus oriented horizontally, so that clothes hangers or hooks arranged thereon do not slide.

For example, the at least one transverse element is coupled in an articulated manner to the at least one main element. The at least one transverse elements can have, for example, at least one sleeve or sub-sleeve, which engages around the at least one main element at least in part. The at least one sleeve or the sub-sleeve here can be designed to be rotatable about the main element. The transverse element possibly has one or more blocking elements, by means of which the transverse element is fixed in a releasable manner on the at least one main element. It is conceivable for the blocking element to be realized in the form of a screw, which is screwed in for example in order to fix the transverse element against the main element. An articulated arrangement allows the clothes-rail system to be adjusted in a flexible and individual manner and to be adapted to the local factors in the room.

For example, the at least one main element and/or the first sub-element and/or the second sub-element and/or the at least one transverse element are/is manufactured from metal, in particular steel and/or stainless steel and/or copper. Metals are robust and hard-wearing, and the necessary stability of the clothes-rail system is realized as a result.

The at least one main element and/or the first sub-element and/or the second sub-element and/or the at least one transverse element advantageously have/has a rough surface, so that clothes hangers or hooks arranged thereon do not slide accidentally. It is possible here for the surface to be formed by an additional layer, in particular (powder) coating or other processes, or else also to be roughened.

It is conceivable for a plastic element made of plastic material, in particular made of elastomers and/or thermoplastic materials, to be arranged on that side of at least one fastening element which is directed away from the main element. For example, a plastic element is arranged on that side of each fastening element which is respectively directed away from the main element. It is possible for this plastic element to be produced from rubber or hard rubber. The plastic element, on the one hand, ensures a better clamping force by way of a higher coefficient of friction and, on the other hand, protects the spatial boundaries against pressure marks.

In some embodiments of the present disclosure, the main element has a third sub-element. The third sub-element can be fixed in a releasable manner to the first sub-element or the second sub-element via a connecting element, for example the third sub-element is fixed in a releasable manner to the first sub-element or the second sub-element via a threaded system or is fixed in a releasable manner to the first sub-element and/or the second sub-element via a plug-fit system. It is precisely in the case of high ceilings, as are found in older apartments or lofts, that a third sub-element or further sub-elements can provide for releasable fixing in the room if the first sub-element and the second sub-element together cannot achieve this on account of insufficient length. It is possible here for the third sub-element to be arranged between the first sub-element and second sub-element or else also between the fastening element and first sub-element or between the fastening element and second sub-element.

Description of an Exemplary Embodiment

An exemplary embodiment of the present disclosure is illustrated in the drawing and will be explained in more detail hereinbelow with reference to the figures.

FIG. 1 illustrates a main element 2 along the lines of one example of the present disclosure. In this example, the main element 2 comprises a first sub-element 6, a second sub-element 7 and a third sub-element 12, wherein the second sub-element 7 and the third sub-element 12 are fixed to one another via a connecting element 15, wherein the sub-elements 6, 7, 12 make up the essential length of the sub-element.

The main element 2 here has a respective fastening element 4 at both of its ends. In addition, the main element 2 has an extension mechanism 5 for extending the at least one main element 2 in the vertical direction.

The extension mechanism 5 here has an inner extension element 8 and an outer extension element 9, wherein the inner extension element 8 has an external thread 11 and the outer extension element 9 has an internal thread 10, wherein the internal thread 10 and the external thread 11 are designed to complement one another.

At least part of the inner extension element 8 is arranged within the second sub-element 7, and a fixing element 14 fixes the inner extension element 8 to the second sub-element 7 such that it cannot rotate.

The extension mechanism 5 here is designed such that, for releasable fastening in a room, the first fastening element 4 and the second fastening element 4 are moved relative to one another by the inner extension element 8 and the outer extension element 9 being rotated in relation to one another, so that the first sub-element 6 and the second sub-element 7 and also the fastening elements 4 move relative to one another. For fastening in the room, the main element is extended until it clamps between two boundaries of the room. These boundaries can be, for example, floors or ceilings of the room, but also pieces of furniture, door frames or beams.

In order to increase safety and to protect the boundaries, plastic elements 13 are arranged on those sides of the fastening elements 4 which are directed away from the extension mechanism 5.

Figure 2:
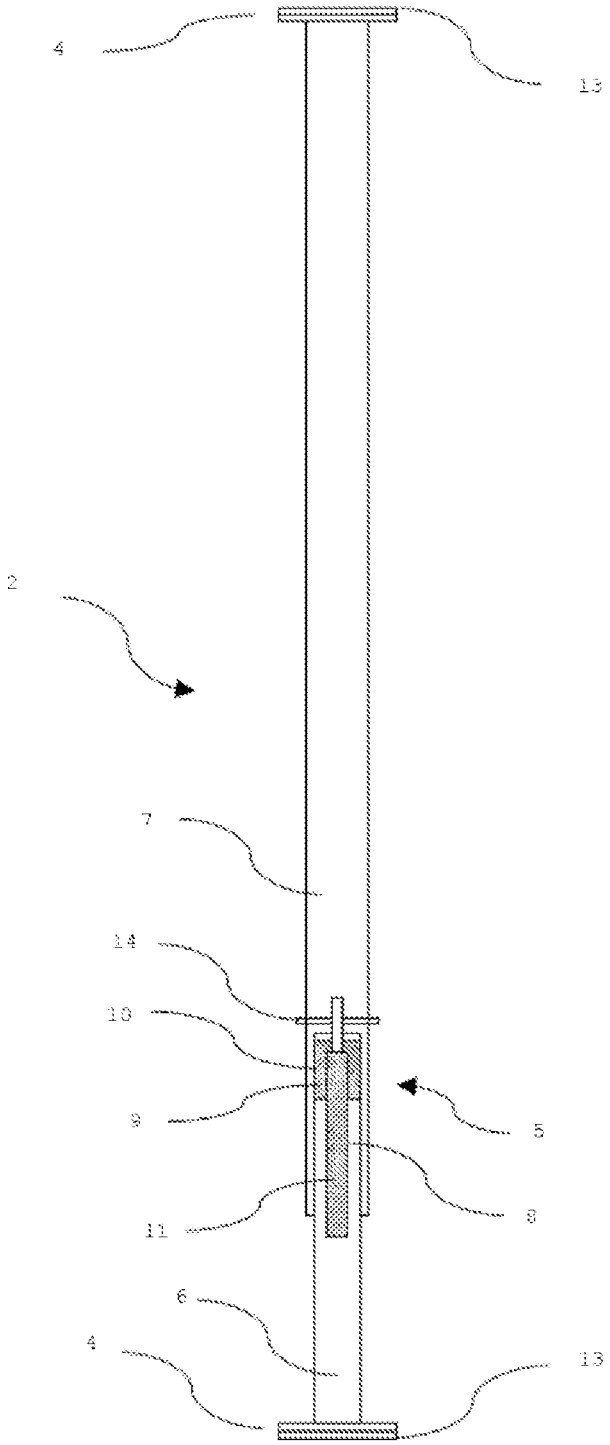
FIG. 2 shows a schematic construction of a main element from FIG. 1 having an extension mechanism according to one example in a non-extended state.

FIG. 2 illustrates the main element 2 from FIG. 1 in a non-extended state. The outer extension element 9 here is arranged at the upper end of the inner extension element 8.

Figure 3:
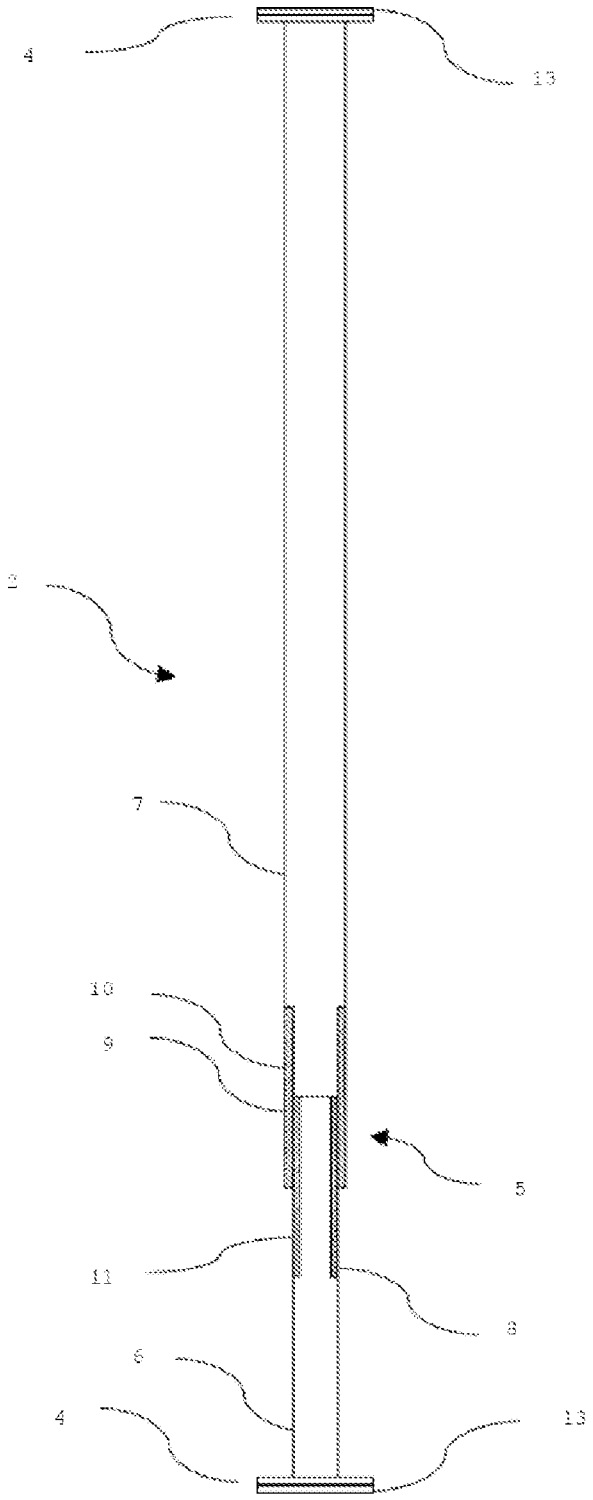
FIG. 3 shows a schematic construction of a main element having an alternative extension mechanism according to one example in an extended state.

FIG. 3 depicts an alternative embodiment of a main element 2 in an extended state. In this case of this embodiment, the inner extension element 8 is arranged on the first sub-element 6 and the outer extension element 9 is arranged on the second sub-element 7.

Figure 4:
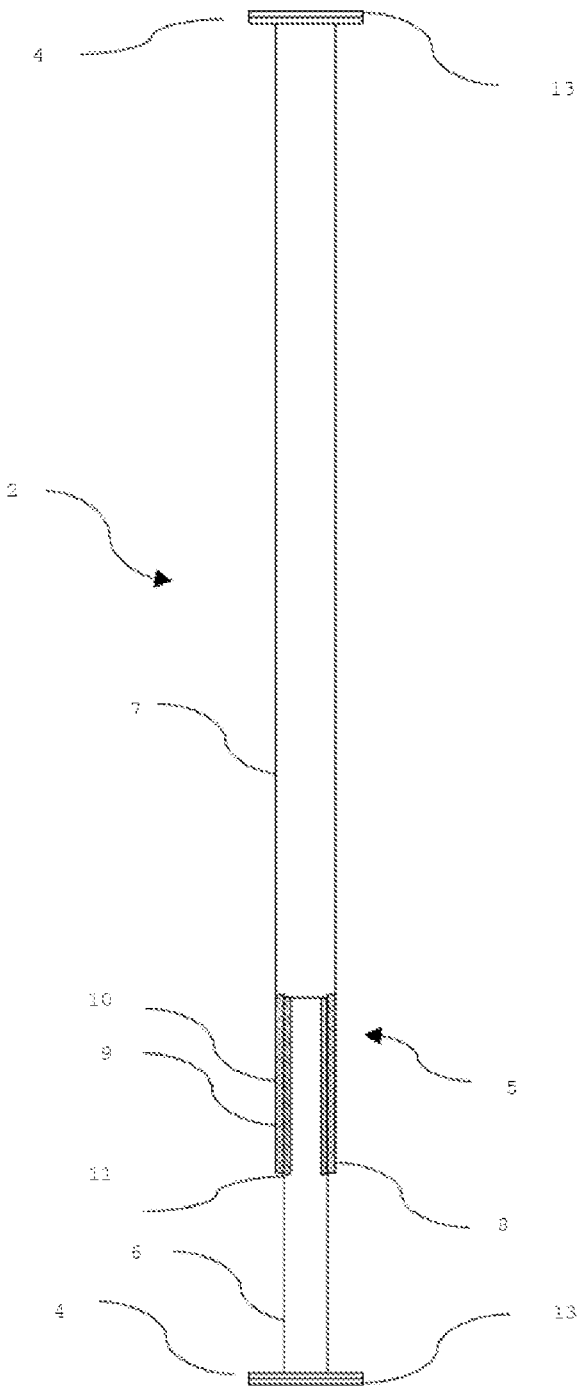
FIG. 4 shows a schematic construction of a main element having an alternative extension mechanism according to one example in a non-extended state.

FIG. 4 shows the main element from FIG. 3 in a non-extended state.

Figure 5:
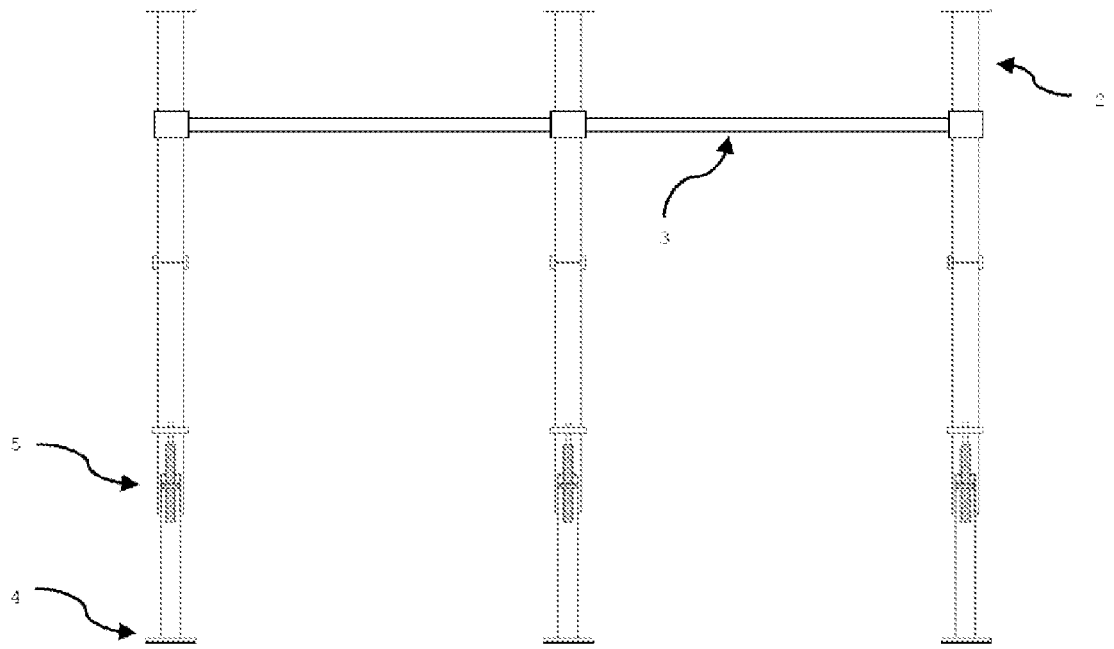
FIG. 5 shows a schematic construction of a clothes-rail system having main elements according to FIG. 1.

FIG. 5 shows, schematically, a construction of an exemplary clothes-rail system 1 having main elements 2 according to FIG. 1. The transverse elements 3 here are coupled in an articulated manner to the main elements 2, and are fixed in a releasable manner thereon.

The transverse elements 3 here are illustrated at the same height, but can also be arranged at different heights on the main elements 2. The transverse elements 3 between different main elements 2 can be arranged in a common plane or also at an angle in relation to one another.

Clothes-rail systems having one, two, four and more main elements are also conceivable.

Figure 6:
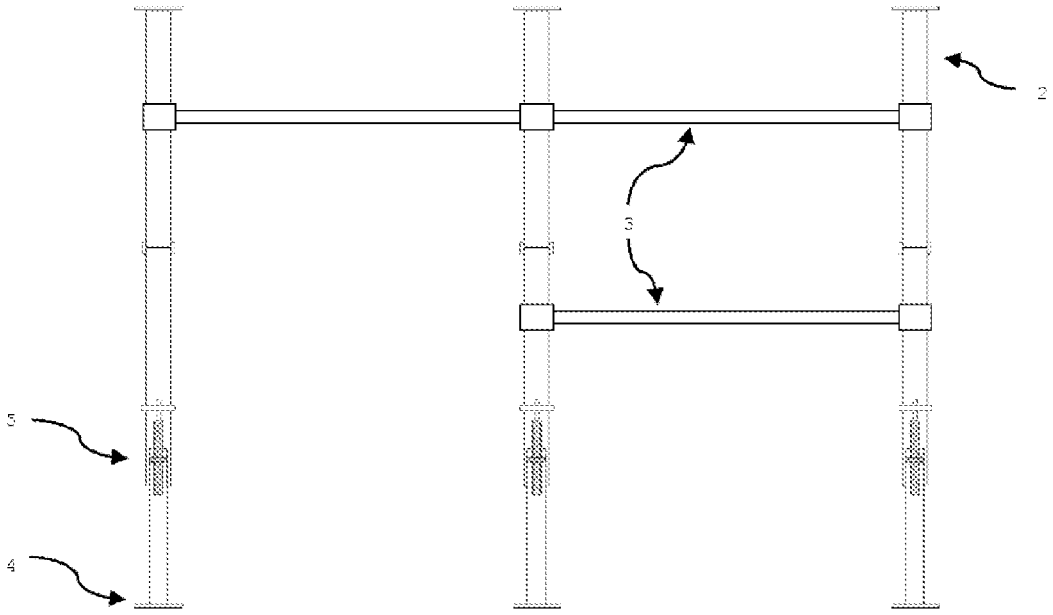
FIG. 6 shows a further schematic construction of a clothes-rail system having main elements according to FIG. 1 with additionally arranged transverse elements according to one example.

FIG. 6 shows a clothes-rail system according to FIG. 5 with an additionally arranged transverse element. It is also conceivable for more than two transverse elements 3 to be fitted between two main elements 2. It is also conceivable for transverse elements to be supplemented or replaced by storage elements (not illustrated) such as, for example, shelves or boxes.

Although the present invention has been described with reference to preferred embodiments, workers skilled in the art will recognize that changes may be made in form and detail without departing from the spirit and scope of the invention.

LIST OF REFERENCE SIGNS

1 Clothes-rail system
2 Main element
3 Transverse element
4 Fastening element
5 Extension mechanism
6 First sub-element
7 Second sub-element
8 Inner extension element
9 Outer extension element
10 Internal thread
11 External thread
12 Third sub-element
13 Plastic element
14 Fixing element
15 Connecting element

The invention claimed is:

1. A clothes-rail system for being fastened in rooms, the clothes-rail system comprising:

at least one vertically oriented main element with a first end and a second end, wherein the at least one vertically oriented main element comprises at least a first sub-element and a second sub-element; and at least one transverse element, wherein the at least one transverse element is arranged on the at least one vertically oriented main element in a direction transverse to the at least one vertically oriented main element, wherein a position in which the at least one transverse element is arranged on the at least one vertically oriented main element is variable, wherein the clothes-rail system comprises at least a first fastening element and a second fastening element, wherein the first fastening element is arranged at the first end of the at least one vertically oriented main element, wherein the second fastening element is arranged at a second end of the at least one vertically oriented main element, wherein the at least one vertically oriented main element has an extension mechanism for extending the at least one vertically oriented main element in a vertical direction, wherein the extension mechanism has an inner extension element and an outer extension element, wherein the first fastening element and the second fastening element move relative to one another for releasable fastening in a room, wherein at least one of the at least one vertically oriented main element or the at least one transverse element is formed from at least one pipe, wherein at least part of the inner extension element is present within the first sub-element and the outer extension element is present within the second sub-element, and wherein the inner extension element is mounted such that the inner extension element cannot rotate relative to the first sub-element and the outer extension element is mounted such that the outer extension element cannot rotate relative to the second sub-element.

2. The clothes-rail system according to claim 1, wherein at least one of the at least one vertically oriented main element, the first sub-element, the second sub-element, or the at least one transverse element comprises a hollow main body.

3. The clothes-rail system according to claim 1, wherein at least one of the at least one vertically oriented main element, the first sub-element, the second sub-element, or the at least one transverse element comprises a cylindrical main body.

4. The clothes-rail system according to claim 1, wherein the first sub-element is movable relative to the second sub-element, wherein at least part of the first sub-element can be moved within the second sub-element.

5. The clothes-rail system according to claim 1, wherein the inner extension element has an external thread and the outer extension element has an internal thread, wherein the internal thread and the external thread complement one another.

6. The clothes-rail system according to claim 1, wherein at least part of the inner extension element is present within the second sub-element and the outer extension element is present within the first sub-element, wherein the inner extension element is fixed in a releasable manner such that the inner extension element cannot rotate relative to the second sub-element and the outer extension element is fixed in a releasable manner such that the outer extension element cannot rotate relative to the first sub-element.

7. The clothes-rail system according to claim 1, wherein the at least one transverse element is arranged perpendicularly relative to the at least one vertically oriented main element.

8. The clothes-rail system according to claim 1, wherein the at least one transverse element is coupled in an articulated manner to the at least one vertically oriented main element.

9. The clothes-rail system according to claim 1, wherein at least one of the at least one vertically oriented main element, the first sub-element, the second sub-element, and the at least one transverse element is manufactured from metal steel, stainless steel or copper.

10. The clothes-rail system according to claim 1, wherein a plastic element made of at least one of an elastomer or a thermoplastic material is arranged on a side of at least one of the first fastening element or the second fastening element which is directed away from the vertically oriented main element.

11. The clothes-rail system according to claim 1, wherein the at least one vertically oriented main element has a third sub-element, wherein the third sub-element is fixed in a releasable manner to the first sub-element or the second sub-element via a connecting element.

* * * * *